US012752884B1

(12) United States Patent
Forrest et al.

(10) Patent No.: US 12,752,884 B1
(45) Date of Patent: Oct. 6, 2026

(54) METHODS OF SOFT BALLAST TANK DECONTAMINATION AND RELATED SYSTEMS AND APPARATUS

(71) Applicant: Correct Craft IP Holdings, LLC, Orlando, FL (US)

(72) Inventors: Kris Forrest, San Martin, CA (US); Eric J. Miller, Orlando, FL (US); Augustus Joseph Chisano, Orlando, FL (US)

(73) Assignee: CORRECT CRAFT IP HOLDINGS, LLC, Orlando, FL (US)

( * ) Notice: Subject to any disclaimer, the term of this patent is extended or adjusted under 35 U.S.C. 154(b) by 470 days.

(21) Appl. No.: 18/372,644

(22) Filed: Sep. 25, 2023

Related U.S. Application Data

(63) Continuation-in-part of application No. 18/103,430, filed on Jan. 30, 2023, now abandoned.

(60) Provisional application No. 63/304,016, filed on Jan. 28, 2022.

(51) Int. Cl.

| | |
|---|---|
| ***B63B 11/04*** | (2006.01) |
| ***B63B 1/00*** | (2006.01) |
| ***B63B 32/70*** | (2020.01) |
| ***B63B 57/02*** | (2006.01) |
| *B63B 57/00* | (2006.01) |

(52) U.S. Cl.
CPC ..... *B63B 11/04* (2013.01); *B63B 1/00* (2013.01); *B63B 32/70* (2020.02); *B63B 57/02* (2013.01); *B63B 2057/005* (2013.01)

(58) Field of Classification Search
CPC ..... B63B 11/00; B63B 11/04; B63B 32/00; B63B 32/70; B63B 57/00; B63B 57/02; B63B 2057/005; B63B 1/00
USPC ..... 114/125
See application file for complete search history.

(56) References Cited

U.S. PATENT DOCUMENTS 5,499,743 A * 3/1996 Blumenkron ..... B65D 88/1656 383/110
5,787,835 A * 8/1998 Remnant ..... B63B 11/04 114/125
6,648,507 B2 * 11/2003 Joshi ..... B65D 88/1656 383/905

* cited by examiner

*Primary Examiner* — Lars A Olson
(74) *Attorney, Agent, or Firm* — Allen, Dyer, Doppelt + Gilchrist, PA

(57) ABSTRACT

A soft ballast tank includes at least one flexible sleeve attached to the tank body and extending at least partially around a tank sidewall. Filling the sleeve with water establishes a desired geometry of at least a portion of the tank body for spraying interior surfaces thereof for decontamination. Hot water is used to fill the sleeve and the hot water is sprayed onto interior surfaces of the tank body through at least one nozzle communicating with the sleeve.

20 Claims, 5 Drawing Sheets

METHODS OF SOFT BALLAST TANK DECONTAMINATION AND RELATED SYSTEMS AND APPARATUS

FIELD OF THE INVENTION

The present invention relates to decontamination of ballast tanks on recreational watercraft to eliminate aquatic invasive species, and more particularly to the decontamination of soft-walled ballast tanks.

BACKGROUND OF THE INVENTION

Due to the proliferation of aquatic invasive species (AIS), it has become a requirement prior to launching recreational watercraft on many lakes and rivers to decontaminate bilges, water lines and tanks. This is typically accomplished with hot water. In the case of tanks, such as ballast tanks, this can be an extremely time-consuming process, as these tanks can hold hundreds of pounds of water and current decontamination procedures entail completely filling all onboard tanks with hot water.

U.S. Non-provisional patent application Ser. No. 17/227,465 (the contents of which are herein incorporated by reference in their entirety) proposes the novel solution of utilizing a hot water spray to decontaminate tanks, which requires significantly less time, water and energy than filling the tanks. As recognized by the '465 application, certain practical challenges are raised when using a hot water spray to decontaminate soft-walled tanks (often called ballast bags and herein referred to as "soft tanks").

In particular, since spray decontamination requires all internal surfaces of the tank to be exposed to the spray, it can be important to ensure that soft tanks maintain a geometry conducive to spray from one or more nozzles reaching all interior surfaces of the soft tank when empty. This generally entails using some means to avoid collapse of the soft tank once emptied. Complicating this is the fact that, in some cases, it is necessary that the soft tank be collapsible (for example, during draining, installation, removal and/or storage). The present invention provides additional solutions to this problem.

SUMMARY OF THE INVENTION

In view of the foregoing, it is an object of the present invention to provide methods of soft ballast tank decontamination and related systems and apparatus. According to an embodiment of the present invention a soft ballast tank comprises a flexible tank body, at least one tank water connection, at least one flexible sleeve, at least one sleeve water connection and at least one nozzle. The flexible tank body includes a tank sidewall extending around a first axis between first and second tank ends, and defines a ballast volume. The tank water connection mounts to the flexible tank body and communicates with the ballast volume to allow filling and draining from an external water source. The flexible sleeve defines at least one sleeve volume separate from the ballast volume and is connected to the tank sidewall extending at least partially around the first axis such that filling the at least one sleeve volume establishes a desired geometry of at least a portion of the flexible tank body. The sleeve water connection communicates with the at least one sleeve volume and allows filling thereof. The nozzle communicates between the sleeve volume and the ballast volume and is operable to spray water from the at least one sleeve volume into the ballast volume.

According to an aspect of the present invention, the sleeve volume is less than 10% of the ballast volume. The sleeve preferably extends at least 270 degrees around the first axis and can extend 360 degrees around the first axis.

According to another aspect, the at least one sleeve extends substantially continuously between the first and second tank ends.

The at least one sleeve can include a plurality of sleeves defining a respective plurality of sleeve volumes, each of the plurality of sleeves connected to the tank sidewall and extending at least partially around the first axis. The plurality of sleeves can either collectively extend substantially continuously between the first and second tank ends or be spaced apart between the first and second tank ends. A connecting sleeve connected to the tank sidewall can extend between the first and second tank ends communicating with each of the plurality of sleeves.

According to a further aspect, the at least one nozzle is formed by one or more perforations in the at least one flexible sleeve.

According to an additional aspect, the ballast tank is carried by the hull of a watersports boat, the watersports boat further including a ballast system and a decontamination system. The ballast system is carried by the hull and operable to fill and drain the ballast volume via the at least one tank water connection. The decontamination system is carried by the hull and operable to supply heated water to the at least one sleeve volume via the at least one sleeve water connection to establish the desired geometry of the at least a portion of the flexible tank body and to spray the heated water into the ballast volume via the at least one nozzle.

According to a method aspect, a method of decontaminating a soft ballast tank includes draining a ballast volume of the soft ballast tank, filling at least one sleeve attached to a flexible tank body of the ballast tank with water to establish a desired geometry of the flexible tank body, and spraying interior surfaces of the flexible tank body with hot water through at least one nozzle communicating with the ballast volume.

These and other objects, aspects and advantages of the present invention will be better appreciated in view of the drawings and following detailed description of preferred embodiments.

DETAILED DESCRIPTION OF PREFERRED EMBODIMENTS

Figure 1:
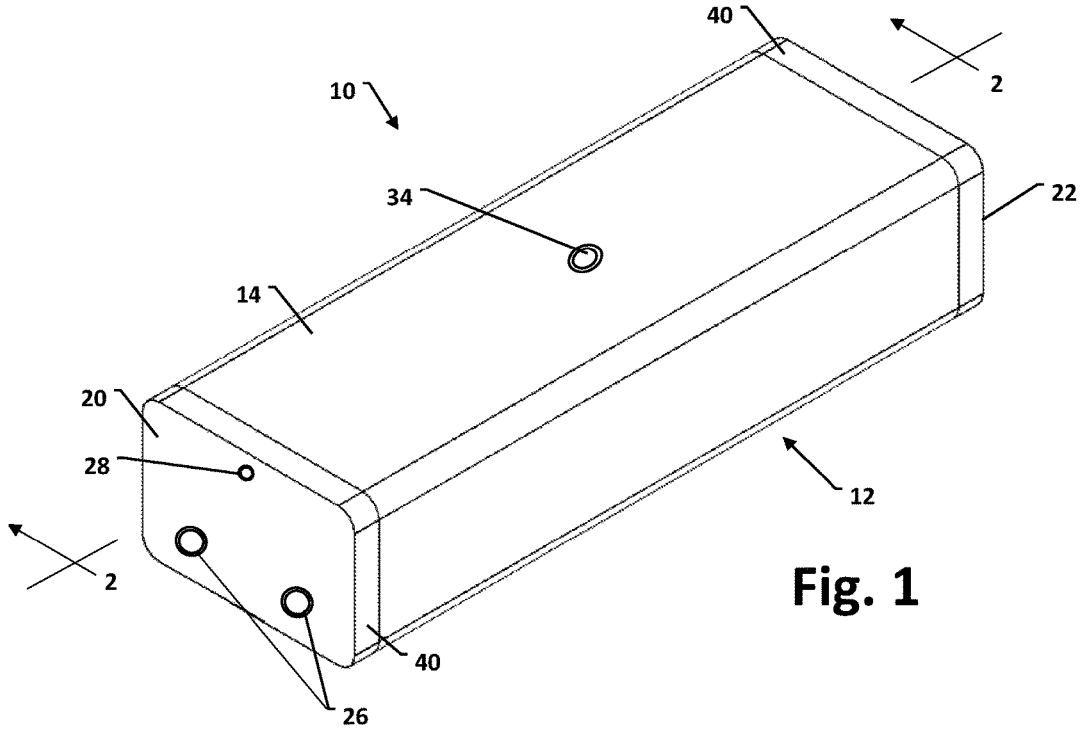
FIG. 1 is a perspective view of a soft ballast tank, according to an embodiment of the present invention.

According to an embodiment of the present invention, referring to FIG. 1, a soft ballast tank 10 includes a flexible tank body 12 including a tank sidewall 14 extending around a first axis 16 between first and second tank ends 20, 22 and defining a ballast volume 24. One or more tank water connections 26 communicate with the ballast volume 24 allowing filling and draining from an external water source to add or remove ballast weight from a watersports craft. A tank vent connection 28 allows air to enter and exit the ballast volume 24.

Figure 2:
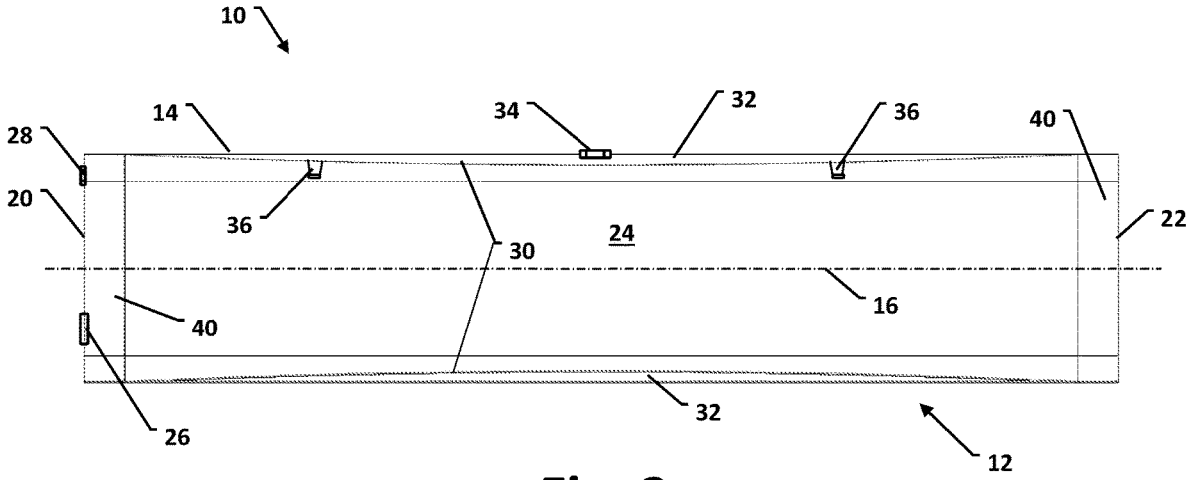
FIG. 2 a sectional view taken along line 2-2 of FIG. 1.

Referring to FIG. 2, a flexible sleeve 30 is connected to the tank sidewall 14 extending at least partially (and, in the depicted embodiment, entirely) around the first axis. A sleeve volume 32 is defined between the flexible sleeve 30 and the tank sidewall 14. At least one sleeve water connection 34 communicates with the at least one sleeve volume and allows filling thereof with hot water from an external source. At least one nozzle 36 communicates between the sleeve volume 32 and the ballast volume 24 and is operable to spray hot water from the sleeve volume 32 into the ballast volume 24 for decontamination thereof.

Filling the sleeve volume 32 establishes a desired geometry of the flexible tank body 12 for decontamination. In general, spray decontamination is preferably performed when the ballast volume is nearly or completely empty. However, the flexible nature of the tank body can result in whole or partial collapse thereof when emptied, such that spray from the nozzles(s) into some parts of the interior of the tank body may be obstructed. The sleeve volume is configured such that, when filled, spray from the nozzle(s) can reach all portions of the interior of the tank body. Additionally, convective heating from the hot water in the sleeve can help facilitate the decontamination action of the spray.

The present invention can be applied to tank body of any shape, and the tank body ends need not be defined by separate walls. In the depicted embodiments, the tank water and vent connection are preferably mounted to the ends, avoiding the need for the connections to penetrate both the tank sidewall and the flexible sleeve.

Unlike a compartmented tank, which might include separated ballast volumes of nearly equivalent volume, the sleeve volume is preferably less than 10% of the ballast volume such that filling the sleeve volume requires significantly less heated water than would be required to fill the entire ballast volume.

In the depicted embodiment, the flexible sleeve extends a full 360 degrees around the first axis; however, as discussed above, the configuration and extent of the sleeve can be varied as long as filling the sleeve volume will establish the desired geometry of the tank body. For instance, a sleeve extending only 270 degrees around the first axis (e.g., around two sides and the top) could be sufficient for some bags. Likewise, a single sleeve contiguous about the first axis need not always be used (e.g., separate sleeves extending up different sides of the tank body).

Also in the depicted embodiment, the sleeve 30 is substantially continuous between the tanks ends 20, 22, being connected to the sidewall 14 in attachment zones 40 adjacent the ends 20, 22. The attachment zones 40 can be formed in any appropriate fashion, depending on the material of the tank sidewall 14 and the sleeve 30 including, but not limited to, sewing, plastic welding, adhesives and the like.

Figure 3:
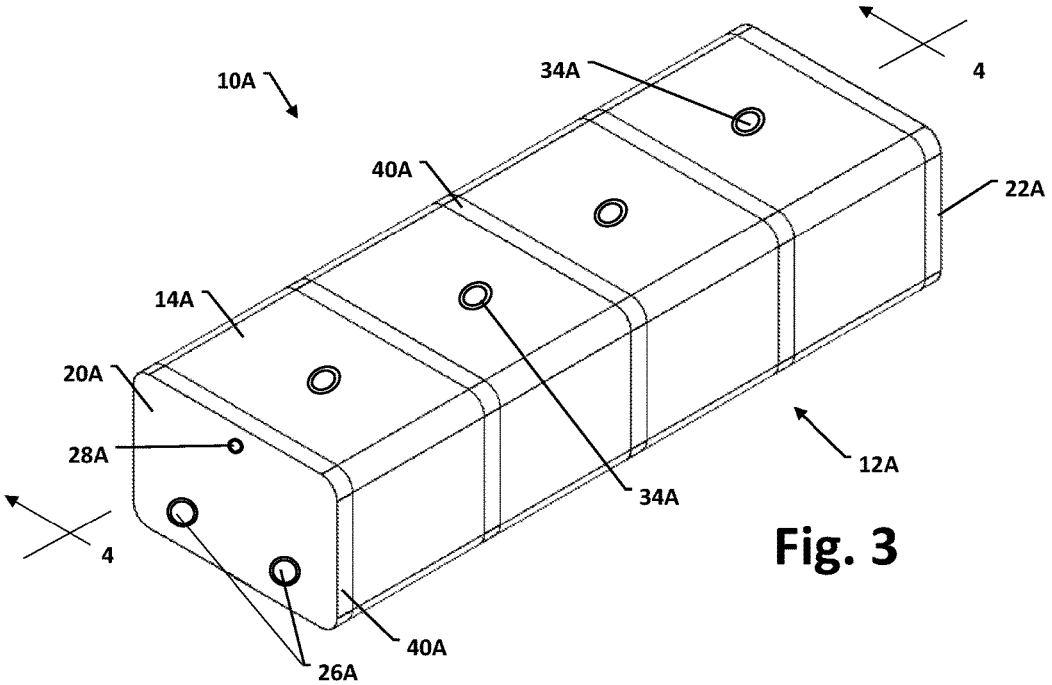
FIG. 3 is a perspective view of a soft ballast tank, according to another embodiment of the present invention.
Figure 4:
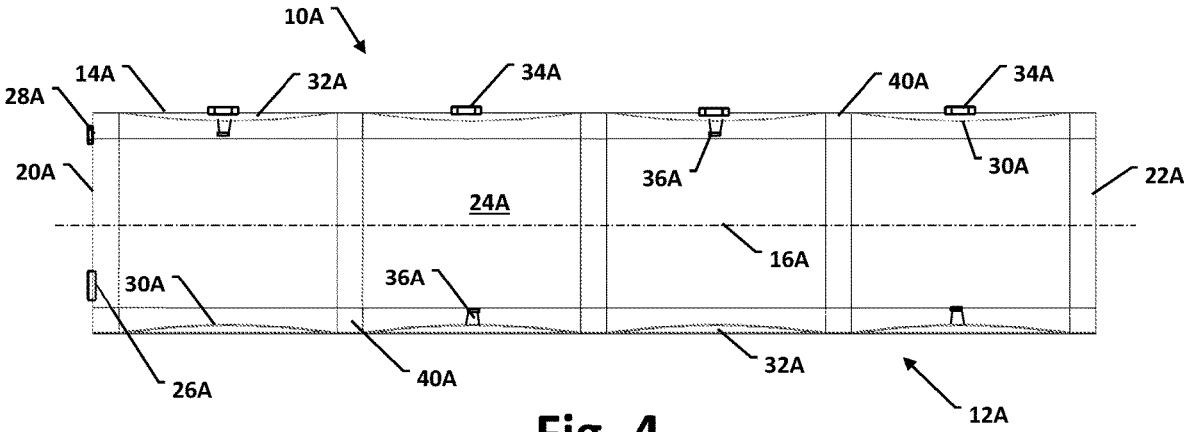
FIG. 4 is a sectional view taken along line 4-4 of FIG. 3.

Referring to FIGS. 3 and 4, in an alternate embodiment of the present invention, in a soft ballast tank 10A includes a plurality of flexible sleeves 30A, each of which defines a respective sleeve volume 32A. In this and subsequent descriptions of alternate embodiments and their corresponding Figures, like elements are labeled with like reference numbers (e.g., flexible tank body 10, 10A, 10B). Except as otherwise specified, the structure and operation of such components is substantially the same as previously described.

In the embodiment of FIGS. 3 and 4, the sleeves 30A collectively extend substantially continuously between the first and second tank ends 20A, 22A interrupted only by the attachment zones 40A. Advantageously, the sleeves 30A are all formed from a continuous piece of material, with the different sleeves being delineated by the attachment zones 40A.

A separate sleeve water connection 34A can be provided for each sleeve 30A, as in the depicted embodiment. Alternatively, the sleeves 30A could be connected. For example, discontinuities could be provided in the attachment zones 40A allowing water to flow between sleeves 30A.

Figure 5:
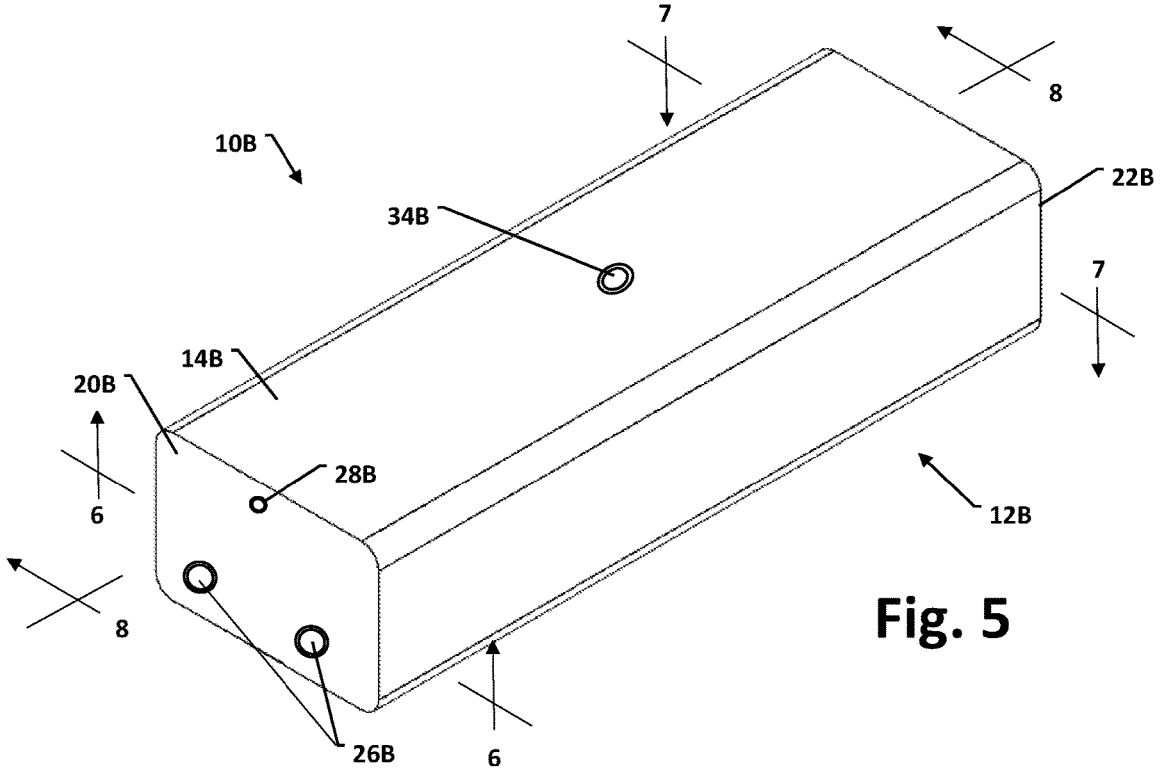
FIG. 5 is a perspective view of a soft ballast tank, according to a further embodiment of the present invention.
Figure 6:
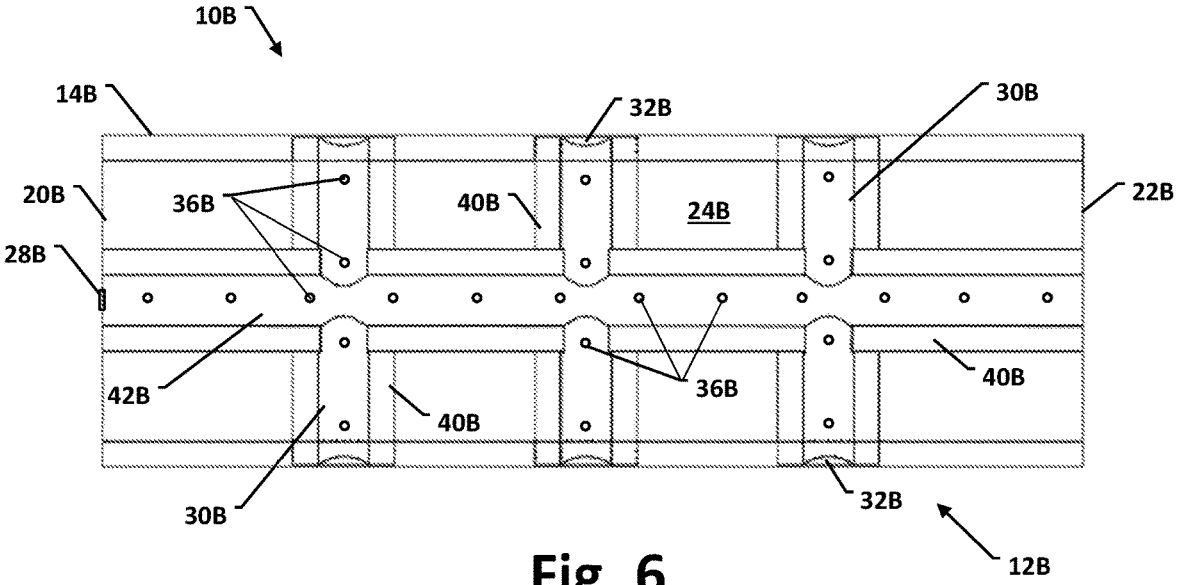
FIG. 6 is a sectional view taken along line 6-6 of FIG. 5.
Figure 7:
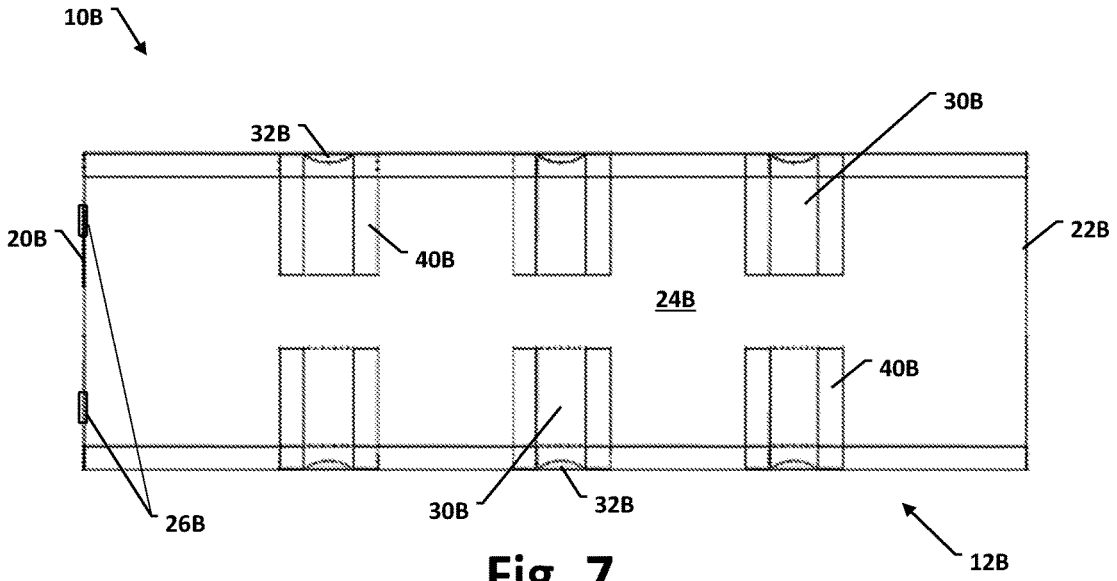
FIG. 7 is a sectional view taken along line 7-7 of FIG. 5.
Figure 8:
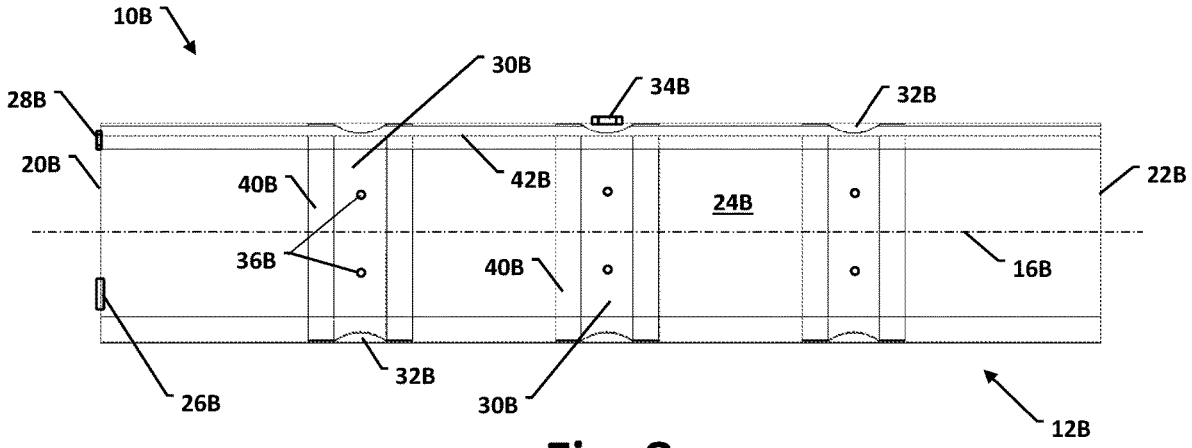
FIG. 8 is a sectional view taken along line 8-8 of FIG. 5.

Referring to FIGS. 5-7, according to a further embodiment of the present invention, a plurality of flexible sleeves 30B are connected to the tank sidewall 14B in spaced apart locations around the first axis 16B between the first and second tank ends 20B, 22B. Each of the sleeves 30B extend partially around the first axis 16B.

The plurality of sleeves 30B are joined via a connecting sleeve 42B, such that hot water supplied to the connecting sleeve 42B or any of the other sleeves 30B will travel therebetween. In the depicted embodiment, a single sleeve water connection 34B connected at a junction between a central sleeve 40B and the connecting sleeve 42B.

In the soft ballast tanks 10, 10A, separate nozzles 36, 36A are attached to the sleeves 30, 30A. In the soft ballast tank 10B, nozzles 36B are formed by perforations made in the walls of the sleeves 30B, simplifying the fabrication of the tank 10B.

Figure 9:
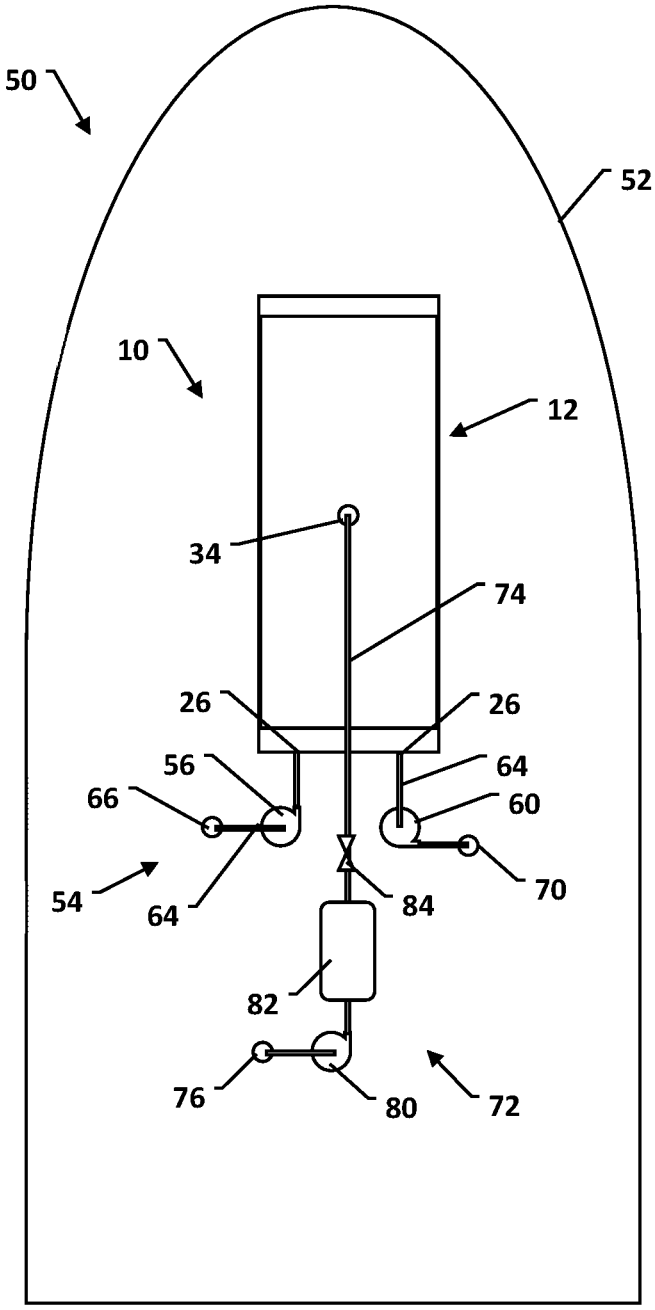
FIG. 9 is a schematic overview of a watersports boat having a soft ballast tank, according to an aspect of the present invention.

Referring to FIG. 9, according to an aspect of the present invention, a watersports boat 50 carries the ballast tank 10 in a hull 52 thereof. A ballast system 54 includes fill and drain pumps 56, 60 located in respective fill and drain lines 62, 64 and communicating with respective tank water connections 26. The pumps 56, 60 are respectively operable to fill and drain the ballast tank 10 through the lines 62, 64 via hull connections 66, 70.

A decontamination system 72 is operable to supply heated water to the sleeve water connection 34 via a decontamination line 74. The decontamination line 74 has a respective hull connection 76. In the depicted embodiment, the system 72 also includes a decontamination pump 80 and water heater 82 located in the decontamination line 74, as well as a spray valve to control initiation of decontamination spray; however, it will appreciated that a decontamination line that simply received heated water from an external source could be employed.

In operation, decontamination of the soft ballast tank 10 is initiated by draining the ballast volume 24. Preferably the ballast volume 24 is drained "substantially completely," which, in the context of the current application, means "within the capability of the ballast system." "Substantially complete" draining of the ballast volume 24, therefore does not necessarily require the complete absence of water. If the ballast volume 24 is already empty, this step is naturally not required.

The flexible sleeve 30 is then filled with hot water via the decontamination line 74, which can also include pumping the water to the water heater 82 for a predetermined holding time and subsequently operating the spray valve 84 to pump the heated water to the sleeve water connection 34. Alternately, heated water from an external source can be supplied directly to the sleeve water connection 34 from an external source coupled to the hull connection 76. As used herein, "hot water" generally refers to water that has been heated above ambient temperature.

The desired geometry of the tank body 12 is established (or maintained) by the filled sleeve 30 and interior surfaces of the tank body 12 are sprayed with the hot water. A duration of spray is preferably selected to be sufficient to kill suspected aquatic invasive species (AIS) based on a temperature of the hot water. In some implementations, the duration can be automatically adjusted based on a sensed water temperature. The decontamination can also include flushing the fill and drain lines 62, 64 with hot water, as necessary.

The above-described embodiments are provided for illustrative purposes; the present invention is not necessarily limited thereto. Rather, those skilled in the art will appreciate that various modifications, as well as adaptations to particular circumstances, will fall within the scope of the invention herein shown and described and of the claims appended hereto.

What is claimed is:

1. A ballast tank comprising:

a flexible tank body including a tank sidewall extending around a first axis between first and second tank ends, the flexible tank body defining a ballast volume;

at least one tank water connection mounted to the flexible tank body and communicating with the ballast volume to allow filling and draining from an external water source;

at least one flexible sleeve defining at least one sleeve volume separate from the ballast volume, the at least one flexible sleeve connected to the tank sidewall and extending at least partially around the first axis such that filling the at least one sleeve volume establishes a desired geometry of at least a portion of the flexible tank body;

at least one sleeve water connection communicating with the at least one sleeve volume and allowing filling thereof; and at least one nozzle communicating between the at least one sleeve volume and the ballast volume and operable to spray water from the at least one sleeve volume into the ballast volume.

2. The ballast tank of claim 1, wherein the at least one sleeve volume is less than 10% of the ballast volume.

3. The ballast tank of claim 1, wherein the at least one flexible sleeve is connected to an interior surface of the tank sidewall.

4. The ballast tank of claim 3, wherein the at least one nozzle is formed by at least one perforation in the at least one flexible sleeve.

5. The ballast tank of claim 1, wherein the at least one flexible sleeve extends at least 270 degrees around the first axis.

6. The ballast tank of claim 5, wherein the at least one flexible sleeve extends 360 degrees around the first axis.

7. The ballast tank of claim 1, wherein the at least one sleeve extends substantially continuously between the first and second tank ends.

8. The ballast tank of claim 1, wherein the at least one sleeve includes a plurality of sleeves defining a respective plurality of sleeve volumes, each of the plurality of sleeves connected to the tank sidewall and extending at least partially around the first axis such that filling each of the respective sleeve volumes establishes a desired geometry of respective portions of the flexible tank body.

9. The ballast tank of claim 8, wherein the plurality of sleeves collectively extend substantially continuously between the first and second tank ends.

10. The ballast tank of claim 8, wherein the plurality of sleeves are spaced apart between the first and second tank ends.

11. The ballast tank of claim 10, further comprising a connecting sleeve connected to the tank sidewall and extending between the first and second tank ends, the connecting sleeve communicating with each of the plurality of sleeves.

12. The ballast tank of claim 11, wherein the at least one sleeve water connection communicates with each of the plurality of sleeves via the connecting sleeve.

13. The ballast tank of claim 1, wherein the at least one nozzle includes a plurality of perforations.

14. The ballast tank of claim 1, wherein the at least one tank water connection is mounted to one of the first and second tank ends.

15. The ballast tank of claim 14, further comprising at least one tank vent connection mounted to one of the first and second tank ends for venting air to and from the ballast volume.

16. The ballast tank of claim 15, wherein the at least one tank vent connection is mounted to one of the first and second tank ends.

17. A watersports boat comprising:

a hull;

a ballast tank carried by the hull and having:

a flexible tank body defining a ballast volume, at least one tank water connection mounted to the flexible tank body and communicating with the ballast volume, at least one flexible sleeve defining at least one sleeve volume separate from the ballast volume, the at least one flexible sleeve connected to the body such that filling the at least one sleeve volume establishes a desired geometry of at least a portion of the flexible tank body, at least one sleeve water connection communicating with the at least one sleeve volume, and at least one nozzle communicating between the at least one sleeve volume and the ballast volume and operable to spray water from the at least one sleeve volume into the ballast volume;

a ballast system carried by the hull and operable to fill and drain the ballast volume via the at least one tank water connection; and a decontamination system carried by the hull and operable to supply heated water to the at least one sleeve volume via the at least one sleeve water connection to establish the desired geometry of the at least a portion of the flexible tank body and to spray the heated water into the ballast volume via the at least one nozzle.

18. A method of decontaminating a ballast tank, the method comprising:

draining a ballast volume of the ballast tank;

filling at least one sleeve attached to a flexible tank body of the ballast tank with water to establish a desired geometry of the flexible tank body; and spraying interior surfaces of the flexible tank body with heated water through at least one nozzle communicating with the ballast volume.

19. The method of claim 18, wherein draining the ballast volume includes substantially completely draining the ballast volume before spraying the interior surfaces of the flexible tank body with heated water.

20. The method of claim 18, wherein spraying the interior surfaces includes spraying the interior surfaces for a predetermined time based on a heated water temperature.

* * * * *